United States Patent [19]

Davis et al.

[11] Patent Number: 4,741,740

[45] Date of Patent: May 3, 1988

[54] FLAME-RESISTANT PROPERTIES OF ARAMID FIBERS

[75] Inventors: James K. Davis; Barbara J. Cates, both of Greensboro, N.C.

[73] Assignee: Burlington Industries, Inc., Greensboro, N.C.

[21] Appl. No.: 905,134

[22] Filed: Sep. 9, 1986

Related U.S. Application Data

[63] Continuation-in-part of Ser. No. 863,038, May 14, 1986.

[51] Int. Cl.[4] ..... D06P 5/00

[52] U.S. Cl. ..... 8/490; 8/130.1; 8/584; 8/925

[58] Field of Search ..... 8/490, 584, 130.1, 925

[56] References Cited

U.S. PATENT DOCUMENTS

| | | | |
|---|---|---|---|
| 3,475,771 | 11/1969 | Quynn | 8/601 |
| 3,506,990 | 4/1970 | Richardson et al. | 8/539 |
| 3,789,091 | 1/1974 | Anderson et al. | 524/119 |
| 3,849,368 | 11/1974 | Anderson et al. | 524/119 |
| 4,059,403 | 11/1977 | Wolf et al. | 8/538 |
| 4,066,396 | 1/1978 | Wolf et al. | 8/489 |
| 4,525,168 | 6/1985 | Kelly | 8/130.1 |

*Primary Examiner*—A. Lionel Clingman

*Attorney, Agent, or Firm*—Nixon & Vanderhye

[57] ABSTRACT

The flame-resistant properties of aramid fibers are improved using a swelling agent to introduce a flame retardant into the fiber. The treated fiber has properties of strength approximating the untreated fiber, flame resistance greater than the untreated fiber and is conveniently dyed to an unlimited range of colors with high color yield. An aqueous dimethylsulfoxide solution is used as the swelling agent.

7 Claims, No Drawings

FLAME-RESISTANT PROPERTIES OF ARAMID FIBERS

CROSS-REFERENCE TO RELATED APPLICATIONS

This application is a continuation-in-part of earlier application Ser. No. 863,038, filed May 14, 1986.

This invention relates to improving the flame-resistance of aramid fibers, especially poly(m-phenyleneisophthalamide) fibers, without adversely affecting the fibers' dyeability.

BACKGROUND OF THE INVENTION

Aramid fibers are highly resistant to heat decomposition, have inherent flame-resistant properties, and are frequently used in working wear for special environments where flame resistant properties are required. Fabrics made of these fibers are extremely strong and durable, and have been widely adopted for military applications where personnel have the potential to be exposed to fire and flame, such as aircraft pilots, tank crews and the like. There is a need for fabrics that have flame-resistant properties that are able to successfully meet even higher performance requirements. Meta-linked aromatic polyamide fibers (aramid fibers) are made from high molecular weight polymers that are highly crystalline and have either a high or no glass transition temperature.

These inherent desirable properties of aramid fibers also create difficulties for fiber processing in other areas; specifically, aramids are difficult to dye and difficult to finish so as to enhance their durable flame-resistant properties.

It is an object of the present invention to provide a process for improving the flame-resistant properties of an aromatic polyamide fiber that will yield an increase in flame-resistance without detracting from the inherent strength of the aramid fibers.

SUMMARY OF THE INVENTION

Disclosed is a continuous or semi-continuous process for improving the flame-resistance of aramid fibers, particularly poly(m-phenyleneisophthalamide) fibers, that includes the step of applying to the fiber at least one flame retardant. The flame retardant may be applied by dipping, spraying, knife-coating, or, in the preferred embodiment, padding onto the fabric, prior to dyeing or prior to further processing operations. In a preferred form the process includes the subsequent step of dyeing the fabric with a compatible dyestuff and a fiber swelling agent. A continuous process for dyeing aramid fibers is disclosed in earlier, commonly-assigned application Ser. No. 863,038 filed May 14, 1986. The disclosure of that application is hereby incorporated by reference to the extent necessary to understand the continuous dyeing process.

Applying a flame retardant prior to solvent dyeing yields a product that has highly durable flame-resistance even after multiple launderings. The reasons for such durability are unclear; however, it is believed that the organic swelling agent used in the dyeing process introduces the flame retardant chemical(s) into the aramid fiber while the fiber is in the swollen state. This allows the fiber to hold the flame retardant tenaciously, possibly even encapsulating the flame retardant in the fiber.

The flame retardance/performance properties of fabrics dyed by the process of this invention are significantly improved, as compared with those of fabrics aftertreated with a flame-retardant finish applied from an aqueous solution following the dyeing and fixing operation. LOI values, as described in more detail below, may be as high as 0.434 for a flame retarded and subsequently solvent dyed T-455 Nomex fabric product produced by the process of this invention. As a means of comparison, undyed T-455 Nomex has an LOI of 0.280.

Fabric pretreated with a flame retardant by the process of this invention exhibits good dyeability; good colorfastness is achieved and increased flame resistant properties are retained even after multiple launderings. The process enables one to engineer protective performance into an aramid fiber chemically, thus providing an expanded range of applications and end uses for the product beyond textile materials made of inherently flame-resistant but otherwise untreated fibers.

Below is a description of the dyeing process and materials that may be used following the flame retardant pretreatment process described above.

Fiber swelling is accomplished in an aqueous solution of one or more fiber swelling agents. The following polar organic solvents have been found to be preferred swelling agents for poly(m-phenyleneisophthalamide) fiber:

N-methylpyrrolidone,
dimethylsulfoxide (DMSO),
dimethylacetamide (DMAc).

Conveniently, these swelling agents are mixed with a compatible diluent, usually water, in various amounts; the swelling agent is present in a major amount, that is, more than half of the total weight of the solution. Good dye fixation in a continuous pad-oven-dry process is obtained using dimethylsulfoxide (DMSO) and water in ratios of DMSO:water of 70:30 to 90:10 with best results at the 90:10 level.

Fibers suitable for the process of this invention are known generally as aromatic polyamides. This class includes a wide variety of polymers as disclosed in U.S. Pat. No. 4,324,706, the disclosure of which is incorporated by reference. Fibers amenable to the process are made from a polymer known chemically as poly(m-phenyleneisophthalamide), i.e., the meta isomer which is the polycondensation product of metaphenylenediamine and isophthalic acid. Below is a listing of fibers now commercially available identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

The polar organic solvent used in the continuous dyeing process has the ability of swell the aromatic polyamide fiber to be dyed with minimum or no damage to the fiber itself. Many polar organic solvents will successfully swell aromatic polyamide fibers to introduce a dye into the fiber but damage the fiber itself and are thus unsuited for use in undiluted form. Fiber damage can be mitigated or avoided by including an otherwise inert and compatible diluent such as water in the swelling agent system.

An important application of fabrics made of aramid fibers is the protection of military personnel. To be fully acceptable for military application, dyed aromatic polyamide fabrics must meet minimum strength requirements as defined in MIL-C-83429A for solution dyed fabrics. For convenience, comparison of the undyed (greige) T-455 fabric with the solution-dyed T-456 fabric and the dyed fabric resulting from the process herein described will be made. Highly polar organic solvents are notorious for degrading mechanical properties of aramid-type fibers, possibly by dissolving or solvating the polymer. To accommodate for this potential concern, the swelling agent system selected, when used at the appropriate temperatures and under the usual processing conditions, will result in a dyed aromatic polyamide fiber or fabric exhibiting at least 80%, preferable at least 90% if not identical to the strength of either the greige T-455 fiber or fabric as the case may be. Expressed conversely, the successfully dyed fiber or fabric exhibits no more than a 20% loss in strength, and preferably far less strength loss, and still will be acceptable for most applications.

The swelling agent system is composed of at least two components: (1) an organic polar solvent, and (2) a compatible, miscible "inert" diluent (inert in the sense that it does not itself enter into the dyeing process or interfere with the dyeing process) to minimize any damage that the polar-organic solvent may cause to the fiber. It will be appreciated that the proportion of organic solvent to diluent, as well as the identity of each of the components, will vary depending upon several factors including the color to be achieved and the nature of the specific poly(m-phenyleneisopthalamide) fiber to be dyed, among others. Suitable swelling agents are selected from dimethylsulfoxide (DMSO), dimethylacetamide (DMAc), and N-methylpyrrolidone; DMSO is preferred. Suitable inert diluents include water, xylene (ortho, meta or para-dimethylbenzene), lower alkene glycols such as ethylene glycol and propylene glycol, alcohols such as n-propanol, methanol, benzyl alcohol, 4-butyrolactone, all of which are compatible with DMSO as the swelling agent, or other relatively high boiling organic liquids otherwise suited to the dyeing process. The selection of swelling agent and diluent is guided by optimum color yield balanced with minimum fiber damage.

While we do not wish to be bound to any particular theory or mode of operation, our experience leads us to believe that the swelling agent modifies the aromatic polyamide fiber by allowing both the dye and the fire retardant to enter the fiber. Examination by mass spectroscopy fails to reveal any swelling agent (DMSO) in the resulting dyed and fire retarded fiber produced by this invention. On the basis of washfastness and durability data for the dyed and fire retarded fabrics, we believe that the mechanism of dye attachment and flame retardant attachment to the fiber is a physical entrapment rather than a chemical covalent bonding. The absence of swelling agent in the fiber following treatment provides an odor-free product, allowing the swelling agent to be more efficiently recovered, and permits practice of the invention without untoward environmental concerns.

The particular type of dyestuff used in the process is not critical and may be selected from acid, mordant, basic, direct, disperse and reactive, and probably pigment or vat dyes. Especially good results with high color yields are obtained with the following classes of dyes, particular examples given parenthetically: acid dyes (Acid Green 25), mordant dyes (Mordant Orange 6), basic dyes (Basic Blue 77), direct dyes (Direct Red 79), disperse dyes (Disperse Blue 56) and reactive dyes (Reactive Violet 1). Mixtures of two or more dyes from the same class or two or more dyes of different classes are contemplated. The dye selected will be compatible with and function effectively in the swelling agent system.

The flame-retardant agents applied prior to the dyeing operation are used in amounts sufficient to increase the already inherent flame-resistant properties of the fabrics. Conventional flame retardants may be used provided that they are compatible with components of the dyeing operation, notably the swelling agent, and impart the required degree of flame-resistant properties to the treated aramid fibers.

Flame retardant (FR) concentrations from 0.1% up to 80% have been studied. However, there appears to be little increase in flame-resistant properties and the possibility exists for considerable additional expense, in concentrations greater than about 20%. The upper limit as a practical matter will be determined by the degree of performance required balanced against the cost of the FR chemical or system used.

Fixation of the flame retardant is by heating, such as using a tenter frame, drying on steam cans or the like.

Preferred flame-retardants used in accordance with the present invention are thermally stable cyclic phosphonate esters prepared by reacting alkyl-halogen-free esters with a bicyclic phosphite. As a class these cyclic phosphonate esters are represented by one of the formulas:

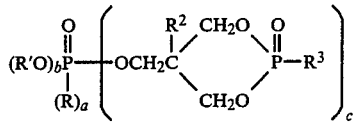

(A)

where a is a 0 or 1; b is 0, 1 or 2, c is 1 or 2 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

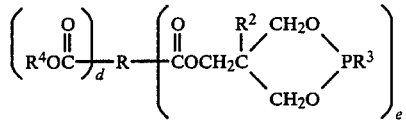

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$), phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenyl.

The preferred compounds are represented by the formula:

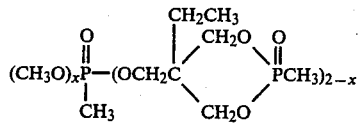

in which x is 0 or 1, and usually a 50:50 mixture of the mono- and di-esters. This mixture of cyclic phosphonate esters is commercially available as Antiblaze 19 and 19T. The preparation of these cyclic phosphonate esters and their use as flame retardants are described in U.S. Pat. Nos. 3,789,091 and 3,849,368, the disclosures of which are hereby incorporated by reference.

The fire retardant may be applied by spraying, coating, contact transfer, pad bath or any other suitable means. The flame retardant may be applied undiluted (if a liquid) or in a suitable aqueous or non-aqueous solvent.

In the dyeing process, in addition to the swelling agent and dye(s), the customary dye pad bath additives and auxiliaries may be included, such as softeners (to improve hand), UV absorbing agents, IR absorbing agents, antistatic agents, water repellants, anti-foaming agents, oil and water repellent resins and chemicals, fluorescent brightening agents, bacteriostats, fungistats and the like. Alternatively, these and other treatments may be applied to the fabric as a post-treatment finish after dyeing, heating, washing, and drying are completed. Preferably the dyed fabric is water washed to remove any residual swelling agent remaining on the fabric. Typically, the wash water remains clear (uncolored) indicating good dye fixation.

The physical form of the fiber to be dyed is also open to wide variation at the convenience of the user. Most dyeing operations and equipment are suited to treatment of woven or knit fabrics in the open width. It is also possible to slasher dye the fibers in the yarn form and thereafter weave or knit the yarns into the item desired.

Testing procedures that were used in the examples are described in detail as follows:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended vertically in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspended in a draft-free area in the same vertical position as in the test cabinet. Char length, the distance (in mm) from the end of the specimen, which was exposed to the flame, to the end of a lengthwise tear through the center of the charred area to the highest peak in the charred area, is also measured. Five specimens from each sample are usually measured and the results averaged.

FR Federal Test Method 5905, flame contact test—a measurement of the resistance of textiles and other materials to flame propagation that exposes the specimen to the flame source for a longer period of time than test method 5903. A test specimen the same size as in the above method is exposed to a high-temperature butane gas flame 3 inches in height by vertical suspension in the flame for 12 seconds, the lowest part of the specimen always 1.5 inches above the center of the burner. At the end of 12 seconds, the specimen is withdrawn from the flame slowly, and afterflaming is timed. Then the specimen is re-introduced into the flame and again slowly withdrawn after 12 seconds and any afterflame timed. For each 12-second exposure the results are reported as: ignites, propagates flame; ignites but is self-extinguishing; is ignition resistant; melts; shrinks away from the flame; or drops flaming pieces.

Limiting Oxygen Index (LOI) is a method of measuring the minimum oxygen concentration needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

EXAMPLE 1

In the example that follows all parts and percentages are by weight and temperatures reported in °F., unless otherwise indicated.

Type T455 Nomex was pretreated with amounts of Antiblaze 19 ranging from 1% to 70% by padding at 20 psi the indicated quantity of Antiblaze 19 (AB19) onto the fabric followed by drying in a tenter frame at 380° F. for 3 minutes. After this pretreatment the fabric was dyed Sage Green by padding onto the fabric at 30 psi (approximately a 90% wet pick-up) a pad bath containing 90 parts by weight DMSO and 10 parts by weight water to which was added a mixture of 1.20% Irgalan Olive 3 BL 133 (Acid Green 70), 0.09% Intralan Orange P2R, and 0.09% Nylanthrene Yellow SL 200 (Acid Yellow 198) to make Sage Green. The pad bath was applied at 190° F. Following padding the fabric was dried in an oven at 220° F. for 3 minutes.

After scouring in a detergent, the LOI was measured and found to range from 0.276 for the fabric containing 1% AB 19 to an upper amount of 0.434 for 20% AB19; no increase in LOI was obtained at concentrations above 20% AB19.

EXAMPLE 2

The procedure of Example 1 was repeated for Nomex type T-455 pre-treated with 10% AB19. The fabric was then dyed Sage Green, using the formulation given in Example 1, at a speed of 20 yards per minute (padded at 190° F. at 20 psi, 90% wet pick-up). The dyed fabric was dried on steam cans maintained at 250° F., resulting in a fabric temperature of 220° F., then rinsed and dried. The fabric was then tested and the results were as follows:

| | |
|---|---|
| Fabric: | |
| weight | 4.78 oz/yd$^2$ |
| count | 72 ends |
| | 46 picks |
| Shrinkage (%) | |
| after 25 launderings | 1.3% warp |
| at 140° F. | 2.0% fill |
| Breaking strength | 179.9 warp |
| | 129.8 fill |
| Light fastness: | |
| xenon 20 hrs. | 4.5 |
| xenon 40 hrs. | 3.5 |
| carbon arc 20 hrs. | 2.0 |
| carbon arc 40 hrs. | 1.0 |
| Color retention: | |
| scoured | 97.49% |
| after 5 launderings | 91.70% |
| after 25 launderings | 95.31% |
| Flammability (LOI): | |
| original | .362 |
| scoured | .365 |
| after 25 launderings | .359 |
| FTM 5903* | |
| afterflame | 0 |
| warp | |
| afterglow | 0 |
| char | 1.1 |
| afterflame | 0 |
| fill | |
| afterglow | 0 |
| char | 1.0 |
| FTM 5905** | |
| afterflame 1 | 0 |
| afterflame 2 | 0 |
| warp | |
| afterglow | 0 |
| char | 2.5 |
| % consumed | 20.8 |
| afterflame 1 | 0 |
| afterflame 2 | 0 |
| fill | |
| afterflow | 0 |
| char | 2.1 |
| % consumed | 17.5 |
| FTM 5905*** | |
| afterflame 1 | 0.3 |
| afterflame 2 | 0 |
| warp | |
| afterglow | 0 |
| char | 2.0 |
| % consumed | 16.7 |
| afterflame 1 | 0.3 |
| afterflame 2 | 0 |
| fill | |
| afterglow | 0 |
| char | 2.2 |
| % consumed | 18.3 |

*FTM 5903 after 25 launderings at 140° F.
**FTM 5905 modified
***FTM 5905 (modified) after 25 launderings at 140° F.

Other embodiments of the invention in addition to those specifically described and exemplified above will be apparent to one skilled in the art from a consideration of the specification or the practice of the invention disclosed herein. It is intended that the specification and examples be considered as exemplary only, with the true scope and spirit of the invention being indicated by the claims that follow.

What is claimed:

1. A process for flame retarding and dyeing a poly(m-phenyleneisophthalamide) fabric, comprising the sequential steps of:

(1) applying from about 0.1% by weight to about 20% by weight of a thermally stable cyclic phosphonate ester flame retardant to a poly(m-phenyleneisophthalamide) fabric and drying the fabric;

(2) contacting the fabric of step (1) with a solution of an organic swelling agent selected from the group consisting of N-methylpyrrolidone, dimethylsulfoxide, and dimethylacetamide, which is adapted to swell said fiber, from about 10 to about 40 parts by weight of a compatible inert diluent, and a solvent-compatible dyestuff dissolved in said solution; and (3) heating the fabric to fix the dye and the flame retardant in the fabric.

2. The process of claim 1, in which the solution is a mixture of said organic swelling agent and water in a weight ratio of from about 70:30 to about 90:10.

3. The process of claim 2, in which the solution contains a mixture of dimethylsulfoxide and water in a weight ratio of about 70:30 to about 90:10.

4. A process of sequentially flame retardant treating and dyeing a poly(m-phenyleneisophthalamide) containing fabric comprising the successive steps of:

(a) applying a solution containing from about 0.1% by weight to about 20% by weight of a thermally stable cyclic phosphonate ester flame retardant to a poly(m-phenyleneisophthalamide) fabric;

(b) drying the fabric;

(c) dyeing the fabric of step (b) with a dyebath solution containing (1) an organic polar solvent swelling agent, (2) from about 10 to about 40 parts by weight of a compatible inert diluent to dilute the swelling agent and protect the fabric form degradation, and (3) a dye for dyeing the fabric, provided that the swelling agent is selected from the group consisting of dimethylsulfoxide, N-methylpyrrolidone and dimethylacetamide and swells the fibers of the fabric and allow the dye to enter into and become fixed in the fiber, the inert diluent is present in an amount such that the mechanical strength of the dyed fabric is at least 80% of the strength of the untreated fabric, and the dye is soluble in the diluent and compatible with the swelling agent, and (d) heating the fiber to fix the dye in the fabric.

5. The process of claim 4 in which the diluent (2) is selected from the group consisting of water, xylene, ethylene glycol, lower alkanols and 4-butyrolactone.

6. Fabric produced by the process of claim 5.

7. A dyed, flame-retardant treated fabric consisting essentially of dyed poly(m-phenyleneisophthalamide) fibers produced by the process of claim 4, the fabric having after 25 launderings a Limiting Oxygen Index (ASTM D-2863-77) of at least 0.35 and a breaking strength at least 80% of that of the unfinished, undyed fabric.

* * * * *